United States Patent [19]

Sonntag et al.

[11] 4,269,258

[45] May 26, 1981

[54] CORE FOR MOLDS FOR ELECTRICALLY MELTING METALS FOR CASTING HOLLOW INGOTS

[76] Inventors: Heinrich Sonntag, Justus-Liebig-Str. 19, 6454 Bruchköbel; Helmut Wallasch, Sandeldamm 6, 6450 Hanau, both of Fed. Rep. of Germany

[21] Appl. No.: 55,220

[22] Filed: Jul. 5, 1979

[30] Foreign Application Priority Data

Jul. 20, 1978 [DE] Fed. Rep. of Germany ..... 2831842

[51] Int. Cl.[3] ..... B22D 27/02

[52] U.S. Cl. ..... 164/252; 164/132; 249/181

[58] Field of Search ..... 164/52, 252, 132; 13/9 ES; 75/10 C; 249/178–181

[56] References Cited

U.S. PATENT DOCUMENTS 2,405,254 8/1946 Hopkins ..... 164/252

*Primary Examiner*—Robert D. Baldwin
*Assistant Examiner*—K. Y. Lin
*Attorney, Agent, or Firm*—Sprung, Felfe, Horn, Lynch & Kramer

[57] ABSTRACT

Mold core for electrically melting metals for casting hollow ingots wherein the core wall is divided lengthwise on its periphery and is designed to be taken apart. The wall is preferably made of at least two partial cylinders between which stave-like keys are positioned which can be removed inwardly.

3 Claims, 4 Drawing Figures

CORE FOR MOLDS FOR ELECTRICALLY MELTING METALS FOR CASTING HOLLOW INGOTS

BACKGROUND

This invention relates to a core for molds for the electrical melting of metals to form hollow ingots, especially for the slag-shielded electrical melting of consumable electrodes, having a wall whose outside dimensions correspond to those of the hollow of the ingot.

The production of hollow ingots, especially by the slag-shielded electrical melting of consumable electrodes, has long been known. In contrast to the method of producing a solid cast ingot and then perforating it, hollow ingot casting has the advantage of a virtually complete utilization of the material and the formation of a high-quality, fine-grain structure substantially free of voids and segregations. The reason for this lies in the short distance between every element of the volume of the hollow ingot and the cooled mold walls, i.e., in a favorable ratio of the internal and external surface area of the hollow ingot to the volume thereof. For the manufacture of hollow bodies such as tanks, hoops or tubes it would therefore be desirable to cast them directly as hollow bodies.

To produce a hollow ingot, it is necessary to provide within the mold a core which during the production of the ingot is withdrawn from the ingot or from the portion thereof which has solidified. A very serious problem is the unavoidable shrinkage of the ingot during cooling, which entails the danger that the ingot may shrink tight on the core.

In casting processes modeled on continuous strand casting, in which a mold with a core fastened therein moves relative to the hollow ingot, there is the danger that the core might "freeze" in the ingot, bringing the entire casting process to a halt and necessitation shutdown. In casting processes using a stationary mold and stationary core, there is the danger that the ingot may shrink tight on the core such that it can no longer be released undestructively from the ingot.

To obviate the problems described above, it has long been known to make the core of foundry sand, and after solidification and cooling of the ingot, to remove the core by destroying it. Such a sand core, however, has the disadvantage of poor thermal conductivity and therefore of an unfavorable influence on grain structure. Especially, however, it is not sufficiently resistant to a superheated molten metal, and particularly to molten slag, which has the tendency to dissolve ceramic compositions and hence also foundry sand. Inclusions of particles of foundry sand in the hollow ingot are especially dangerous.

It is consequently necessary to use metal cores, which must necessarily be liquid cooled. In order in this case to prevent the hollow ingot from shrinking tight on the core, attempts have already been made to make the wall of the core a corrugated wall having corrugations running parallel to the long axis of the core, so as to provide it to some extent with an elastic compressibility. In this case, however, a corresponding corrugated profile is necessarily formed on the inside of the hollow ingot, and has to be removed by a difficult working procedure. Furthermore, the ingot fills the grooves between the corrugations of the core, so that the radial compressibility is largely lost. Such attempts, therefore, have not resulted in success.

Attempts have furthermore been made to make only the surface of a metal, water-cooled core compressible radially. For this purpose it has become known to coat the core surface with a compressible, inorganic layer of material of good thermal conductivity, although the selection of the material has been left open. Thus far no material has become known which even remotely corresponds to these requirements. It must be considered that the nature of such a substance excludes good thermal conductivity. Furthermore, as already stated above, virtually all ceramic materials are attacked by hot, molten slag, so that a core coated in this manner would not last through a single casting operation.

SUMMARY

The invention is therefore addressed to the problem of devising a core of the kind described above, whose outer surface corresponds to the shape of the ingot cavity, and which can be removed from the ingot even after the ingot has shrunk tight on the core.

The solution of this problem is achieved in accordance with the invention in the core described above in that the core wall is divided lengthwise on its periphery and is designed to be taken apart. It is especially desirable that the wall be composed of at least two partial cylinders between which stave-like keys are disposed, which are removable inwardly.

Such a core wall is assembled from its constituent parts prior to the casting of a hollow ingot by electrical melting, making use of appropriate clamping and spreading means, and it is disposed in a generally concentric manner within a mold. After the hollow ingot has been formed between the core and the mold, the ingot shrinks fast onto the core. By simple disassembly, however, especially by the inward extraction of the stave-like keys, the core can be removed piece by piece from the ingot cavity and re-used for the next casting operation.

It is especially desirable for the contact surfaces between the partial cylinders and the keys to be at an acute angle to a radial plane which is the plane of symmetry of the keys, the base of the angle being directed outwardly. If the pressure of the ingot on the core should become excessively great, and if the aperture angle of the contact surfaces between the partial cylinders and the plugs is appropriately selected, the keys will be forced slightly inwardly, permitting the partial cylinders to move toward one another to a corresponding extent. The end result will be a reduction of the diameter of the core which can thus yield to the great compressive stresses of the hollow ingot.

DESCRIPTION OF THE DRAWING

Additional advantageous developments of the subject matter of the invention are given in the following description taken in conjunction with the accompanying drawing wherein.

DESCRIPTION

Figure 1:
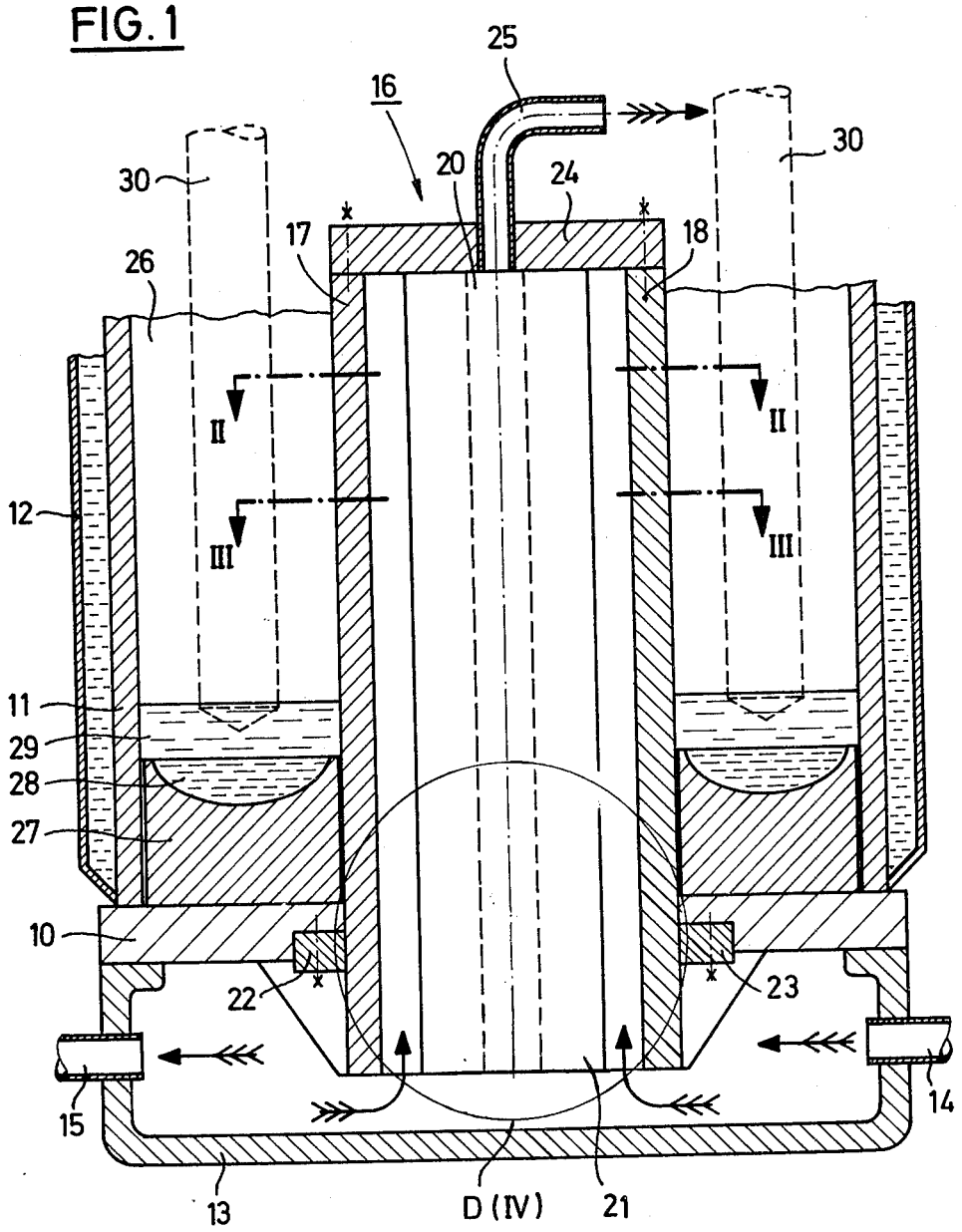
FIG. 1 is a vertical cross-sectional view taken through the mold part of a slag-shielded electrical melting apparatus for the production of a hollow ingot.

In FIG. 1, a mold 11 is placed on a mold bottom 10 and is surrounded by a cooling jacket 12. Underneath the mold bottom 10 there is a cooling water case 13 having an inlet 14 and an outlet 15.

A core 16 in inserted into the mold bottom 10 and consists of two partial cylinders 17 and 18 and of two stave-like keys 19 and 20 of which only the back one 20 is shown in phantom in FIG. 1. Additional details can be seen in FIGS. 2 to 4. The bottom end 21 of the core extends considerably into the water case 13, thereby increasing the cooling surface considerably. The partial cylinders 17 and 18 are provided on their outer periphery with flange sectors 22 and 23 which are bolted sealingly but releasably to the mold bottom 10. The bolting and sealing of the flange sectors must also permit a radial displacement of the partial cylinders 17 and 18. This also is true of a top closure plate 24 in whose center an additional cooling water outlet 25 is disposed. With this cooling water outlet it is possible to produce an upward flow of cooling water through the core 16 from the water case 13. The cooling system provides protection also for the necessary seals.

Between the mold 11 and the core 16 there is formed a cylindrical cavity 26 in which a hollow ingot 27 has begun to form, at the top of which there is a pool of molten metal 28. On this pool of molten metal floats a molten layer of slag 29 in which a plurality of consumable electrodes 30 are immersed at equal intervals about the circumference of the mold. Between these electrodes and the hollow ingot 27, or between adjacent electrodes, there is a difference of potential on the basis of which a flow of electric current is produced through the slag layer 29, resulting in the melting of the electrodes. Details of this process, however, are in the state of the art, so that further explanations can be dispensed with.

Figure 2:
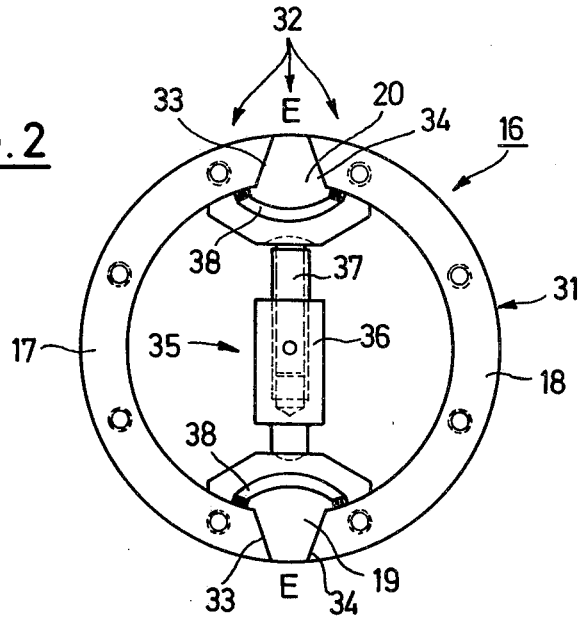
FIG. 2 is an enlarged horizontal cross-sectional view taken along line II—II of FIG. 1.
Figure 3:
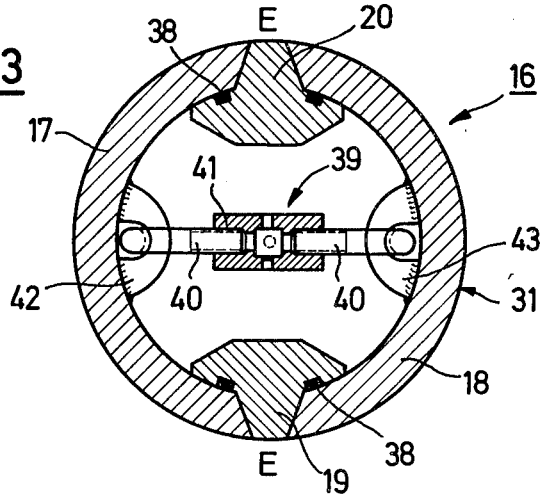
FIG. 3 is also an enlarged horizontal cross-sectional view taken along line III—III of FIG. 1.

In FIGS. 2 and 3, the core 16 has a cylindrical external surface 31 corresponding to the cavity in the ingot and formed by the envelope surface of a cylinder 32 formed by the partial cylinders 17 and 18 and by the stave-like keys 19 and 20. Between the partial cylinders 17 and 18 and the keys 19 and 20 are the interfaces 33 and 34 disposed at an acute angle to a radial plane E—E which is the plane of symmetry of the keys 19 and 20. The base of this angle is directed outwardly, the angle opening such that the keys 19 and 20 can slip inwardly.

Between the keys 19 and 20 a plurality of spreader jacks 35 is distributed through the height of the core, these jacks having a resilient member, not shown in detail, which permits the keys 19 and 20 to yield toward one another to a limited extent. In the present case the spreader jacks 35 are screw jacks composed of a threaded sleeve 36 and a threaded spindle 37, each mounted in one of the keys. By turning the threaded sleeve 37 it is possible to force the keys 19 and 20 apart against the partial cylinders 17 and 18. A seal is provided by the gaskets 38.

As shown in FIG. 3, draw jacks 39 are disposed between the partial cylinders 17 and 18, and they, too, are distributed through the height of the core between the spreader jacks 35 and at right angles thereto. The draw jacks 39 consist each of two oppositely threaded spindles 40 and one spindle nut 41. The outer ends of spindles 40 are hooked into the eyes 42 and 43 which are affixed to the partial cylinders 17 and 18. In this manner the partial cylinders 17 and 18 can be drawn against the keys 19 and 20.

It can be seen in FIGS. 2 and 3 that the keys 19 and 20 are of a somewhat T-shaped cross section, and that the crossbar of the T bears against the partial cylinders from the inside, the gaskets 38 being disposed between the crossbar and the partial cylinders on both sides of the stem of the T.

Figure 4:
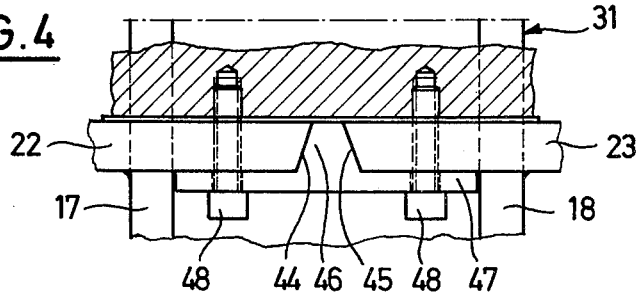
FIG. 4 is a detail view taken within the circle D (IV) of FIG. 1.

FIG. 4 shows how the unavoidable seam between the flange sectors 22 and 23 is sealed. For this purpose, the ends of the flange sectors 22 and 23 are provided with slanting surfaces 44 and 45 forming a V-shaped gap. A sealing body 46 of matching shape is placed in this gap and forms a prolongation of a flange plate 47 which is tightened against the flange sectors 22 and 23 by means of two bolts 48. When all of the bolts have been removed and the sealing body 46 has been removed, the flange sectors 22 and 23 can be driven inwardly against one another so that the ingot can be separated from the core 16.

What is claimed is:

1. A mold core for the electrical melting of metals to form hollow ingots, comprising: means forming a longitudinally divided and disassemblable cylindrical wall having outer dimensions corresponding to that of the ingot cavity, the means including at least two partial cylindrical shells and at least two inwardly removable stave-like pressure members each having a radial portion extending between two shells, and abutting same along two contact surfaces, a crossbar bearing from within on the cylinder shells to define with the radial portion a generally T-shaped cross section for each pressure member and gasket means between the crossbar and the inner surface of the shells for providing a liquid-tight seal, thrust tightening means connected between the pressure members for radially moving same and draft tightening means connected between the shells for radially moving same.

2. The core of claim 1, wherein the contact surfaces between the shells and the radial portion of the pressure members are at an acute angle with respect to the radial plane extending symetrically through the pressure member the vertex of the angle directed outwardly.

3. The core of claim 1 further comprising a bottom wall through which the bottom ends of the cylindrical wall extends and a water enclosure positioned below the bottom wall and into which the cylindrical wall extends and means coactive with the cylindrical wall for sealing the bottom wall with respect to the water enclosure.

* * * * *